United States Patent [19]

Imura et al.

[11] Patent Number: 5,022,372

[45] Date of Patent: Jun. 11, 1991

[54] FUEL DELIVERY RAIL ASSEMBLY

[75] Inventors: Izumi Imura, Shizuoka; Tatsuhiko Uesugi; Toshiaki Yoshimura, both of Numazu, all of Japan

[73] Assignee: Usui Kokusai Sangyo Kaisha Ltd., Shizuoka, Japan

[21] Appl. No.: 323,783

[22] Filed: Mar. 15, 1989

[30] Foreign Application Priority Data

Mar. 15, 1988 [JP] Japan ..... 63-33158
Apr. 4, 1988 [JP] Japan ..... 63-44794

[51] Int. Cl.[5] ..... F02M 55/02

[52] U.S. Cl. ..... 123/469; 123/468; 123/456; 285/381

[58] Field of Search ..... 123/468, 469, 470, 472, 123/456; 285/381, 382

[56] References Cited

U.S. PATENT DOCUMENTS

| | | | |
|---|---|---|---|
| 3,163,449 | 12/1964 | Westfall | 285/381 |
| 3,972,548 | 8/1976 | Roseen | 285/381 |
| 4,384,404 | 5/1982 | Watine | 285/381 |
| 4,457,280 | 7/1984 | Hudson, Jr. . | |
| 4,519,369 | 5/1985 | Hudson | 123/468 |
| 4,798,187 | 1/1989 | Hudson | 123/469 |
| 4,875,270 | 10/1989 | Krips | 285/381 |
| 4,915,739 | 12/1987 | Ruegg | 285/381 |

FOREIGN PATENT DOCUMENTS

| | | | |
|---|---|---|---|
| 48917 | 7/1911 | Austria | 285/381 |
| 890014 | 9/1953 | Fed. Rep. of Germany | 285/382 |
| 59-40577 | 3/1984 | Japan . | |
| 135540 | 12/1929 | Switzerland | 285/381 |

*Primary Examiner*—Carl Stuart Miller
*Attorney, Agent, or Firm*—Wenderoth, Lind & Ponack

[57] ABSTRACT

A fuel delivery rail assembly is disclosed for supplying fuel to a plurality of fuel injectors in an engine. The assembly includes an elongated conduit having a rectangular or square hollow section with a fuel passage therein and a plurality of sockets for making fluid communication between the conduit and the injectors. One end portion of the conduit at the fuel inlet side thereof is transformed into a circular hollow section by shrinking work or enlargement work from said rectangular or square section. Within the inside of the circular hollow section a fuel inlet pipe is inserted directly or indirectly via a straight adaptor and is brazed together, whereby the fuel inlet pipe is connected in alignment with the conduit.

7 Claims, 3 Drawing Sheets

FUEL DELIVERY RAIL ASSEMBLY

BACKGROUND OF THE INVENTION

This invention relates to a fuel delivery rail assembly for an internal combustion engine, especially for an automotive engine, equipped with a fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine.

An example of the fuel delivery rail assembly utilized for a straight-type 4 cylinder engine is shown in FIG. 8 of the attached drawings. In this assembly, an elongated conduit 1 having a rectangular or square hollow section with a fuel passage therein extends along the direction of a crank shaft. On the fuel supply side of the conduit 1, fuel is supplied through a fuel inlet pipe 2 connected to the front end of the conduit 1, and on the fuel return side of the conduit 1, remaining fuel is ejected through a fuel return pipe 3. To the bottom side of the conduit 1, four sockets 4 are fixed complying with the predetermined mounting orientations so as to receive associated tips of fuel injectors. The axial directions of the sockets should precisely align with the respective axial direction of the injectors. Furthermore, pitch lengths between adjacent sockets should precisely coincide with the corresponding pitch lengths between associated injectors.

To the conduit 1, two thick brackets 5 are also fixed and project perpendicularly from the conduit 1 for the purpose of connection to the engine.

As shown in FIG. 8, the fuel return pipe 3 is usually perpendicularly attached to the conduit 1. On the other hand, the fuel inlet pipe 2 is attached to the conduit 1 in various fashions, generally via connecting means such as a straight tubular adaptor 6, due to the fact that it is difficult to connect the inlet pipe 2 having a circular hollow section to the conduit 1 having a rectangular or square section.

Another prior art device is shown in FIG. 9, in which connecting adaptors 12 and 13 are welded to the ends of the elongated conduit 1 having a fuel passage 1A therein. The fuel inlet adaptor 12 receives fuel from an associated adaptor 17 through a fuel inlet pipe 18 fixed to a pressure regulator for the engine. The remaining fuel is ejected through a fuel return adaptor 13 fixed adjacent to the distal end of the conduit 1.

The configuration of the fuel inlet adaptor 12 is formed as shown in FIG. 10. To the flat circular rear surface 14 of the adaptor 12, a front edge of the rectangular conduit 1 is attached and welded by brazing work while kept in abutment with the surface 14 to establish a perfect connection.

However, in such conventional assemblies, the inside area of the fuel passage is abruptly restricted within the transition from a fuel inlet opening 15 having an interior diameter D to a smaller hole 16 having an interior diameter d. For example, when the height H of the conduit 1 is 12 mm, the width L is 25 mm, the thickness of the wall of the conduit 1 is 1.6 mm, and the interior diameter D of the opening 15 is 15 mm, the interior diameter d of the hole 16 becomes about 8 mm, resulting in an abrupt decrease of area with a great loss of fuel pressure.

In FIGS. 11A and 11B, undesirable welding patterns of the prior art are shown. When the adaptor 12 is welded to the conduit 1, if the edge surface 19A of the conduit 1 is cut in oblique section FIG. 11A, or the edge surface 19A is contoured in waved fom FIG. 11B, welding defects causing a fuel leakage are liable to occur. Furthermore, such welding patterns are apt to generate misalignment of the axial lines between the adaptor 12 and the conduit 1. Such misalignment causes a defective installation of the fuel delivery rail assembly to the engine. Due to the fact that the adaptor 12 is provided with a stepped interior surface which should be machined smoothly, it becomes costly to manufacture.

In the U.S. Pat. No. 4,457,280 to Hudson, issued July 3, 1984, there is disclosed a fuel rail assembly for holding a plurality of electromechanical fuel injector elements in aligned positions on an internal combustion engine. The beam portion of the fuel rail is comprised of two elongated manifold members with overlapping sides brazed together. Although a fuel inlet nipple is directly inserted into the front end of the beam portion, this assembly is apparently costly to manufacture.

Japanese utility model public disclosure No. 40577/1984 discloses a fuel delivery rail assembly in which both fuel inlet and return pipes are fixed perpendicularly to the conduit. However, in such a design, there is a disadvantage that fuel supply performance is obstructed by back pressure due to a piping resistance.

SUMMARY OF THE INVENTION

It is an object of the present invention to overcome the above disadvantages and to provide a precisely arranged fuel delivery rail assembly.

Another object of the present invention is to provide an economical fuel delivery rail assembly Still another object of the present invention is to establish a smooth fuel flow within the inlet side of the assembly thereby to reduce a pressure loss of the pressurized fuel.

According to the invention, there is provided a fuel delivery rail assembly for an internal combustion engine. The assembly includes an elongated conduit having a rectangular or square hollow section with a fuel passage therein and, a plurality of sockets perpendicularly attached to said conduit. One end of each of said sockets is in fluid communication with said fuel passage, and the other end of each of said sockets is adapted to receive a tip of a fuel injector, characterized in that one end portion of said conduit at the fuel inlet side thereof is transformed into a circular hollow section by shrinking work or enlargement work from said rectangular or square section. Within the inside of said circular hollow section, a fuel inlet pipe is inserted directly or indirectly via straight connecting means and is secured thereto by brazing work, whereby said fuel inlet pipe is connected in alignment with said conduit.

Within the scope of the invention, the rectangular or square hollow section of the front end of the conduit is processed through pressing work, swaging work or punching work to thereby be shrunk or enlarged, and transformed into a circular hollow section. Then, the fuel inlet pipe is directly or indirectly inserted into the resultant circular section and brazed thereto.

With the results of the invention, most of welding defects and misalignments of axial directions are eliminated, so that a ratio of rejected parts is considerably reduced. In addition, by virtue of reduction of working steps, the assembly becomes more economical. Since the pressure loss at the inlet side of the conduit is reduced, the fuel can flow into the conduit more smoothly.

Other features and advantages of the invention will become apparent from a reading of the specification, when taken in conjunction with the drawings, in which, like reference numerals refer to like elements in the several views.

DESCRIPTION OF THE PREFERRED EMBODIMENT

Figure 1:
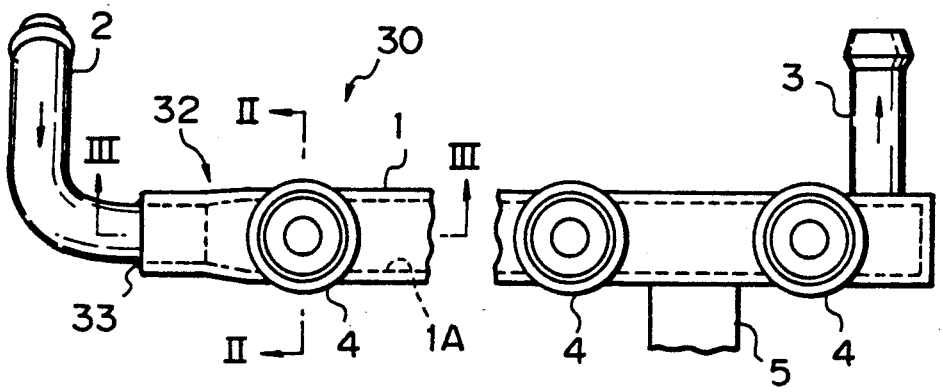
FIG. 1 is a partly broken away bottom view of a first type of fuel delivery rail assembly according to the invention.
Figure 2:
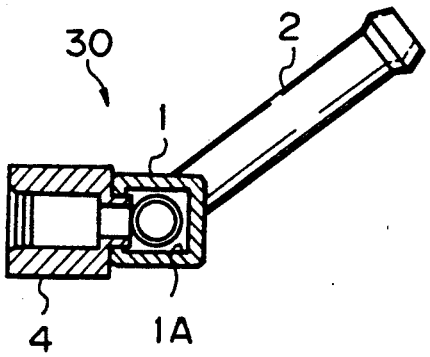
FIG. 2 is a sectional view taken along the line II—II in FIG. 1.
Figure 3:
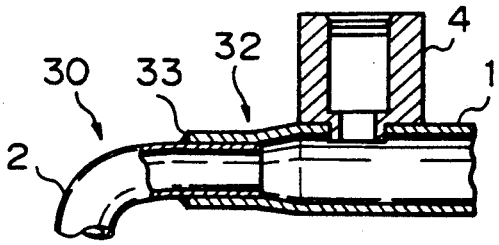
FIG. 3 is a sectional view taken along the line III—III in FIG. 1.

The fuel delivery rail assembly according to the invention is divided into two types, one of which is a shrinking type utilizing shrinking work and the other of which is an enlargement type utilizing enlargement work. FIGS. 1 to 4 illustrate the former type and FIGS. 5 to 7 illustrate the latter type.

Referring to FIGS. 1 to 4, there is shown a fuel delivery rail assembly 30 of the first type. Some portions are omitted for illustrative simplification. The front end 32 at the inlet side of the conduit 1, which has a square hollow section with a fuel passage 1A therein, is shrunk from its outside and its sectional form is transformed into a circular hollow section by pressing work. Within the front end 32, a fuel inlet pipe 2 is inserted and brazed thereto along the peripheral portion 33, whereby the fuel inlet pipe 2 is directly connected in alignment with the conduit 1. Shrinking work of the front end 32 of the conduit 1 is accomplished by various methods, such as pressing or swaging work. In a specific working step, a tailstock spindle is inserted into the front end 32.

Figure 4:
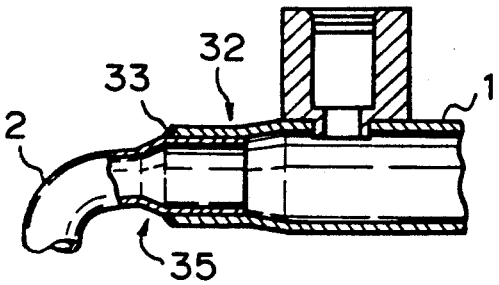
FIG. 4 is a sectional view, similar to FIG. 3, of a modified embodiment of the invention.

In FIG. 4, there is shown an alternative embodiment for the case in which the outside diameter of the fuel inlet pipe is relatively small as compared with the inside diameter of the front end 32 of the conduit 1. In such a case, the distal end 35 of the fuel inlet pipe 2 may be enlarged in compliance with the shrunk diameter of the front end 32, and then the distal end 35 can be brazed to the front end 32 at the peripheral portion 33. With this method, there is an advantage that the invention can also be effected in a case where there is a considerable difference between the outside diameter of the fuel inlet pipe 2 and the outside dimension of the conduit 1.

Figure 5:
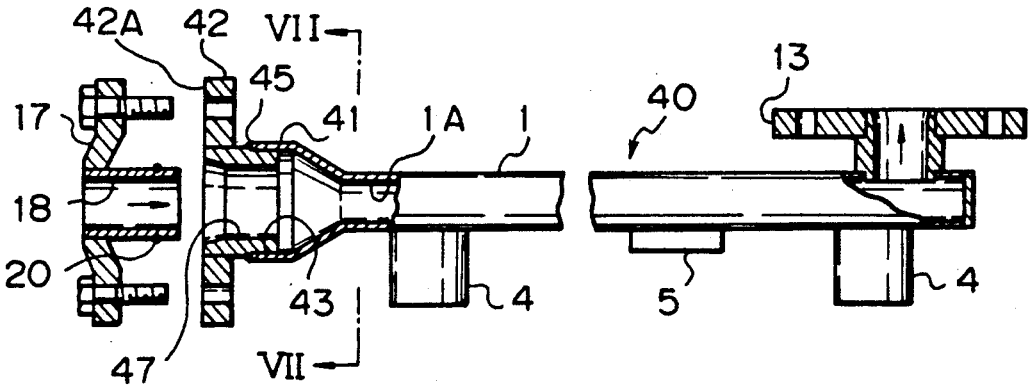
FIG. 5 is a partly broken away vertical sectional view of a second type of fuel delivery rail assembly according to the invention.
Figure 6:
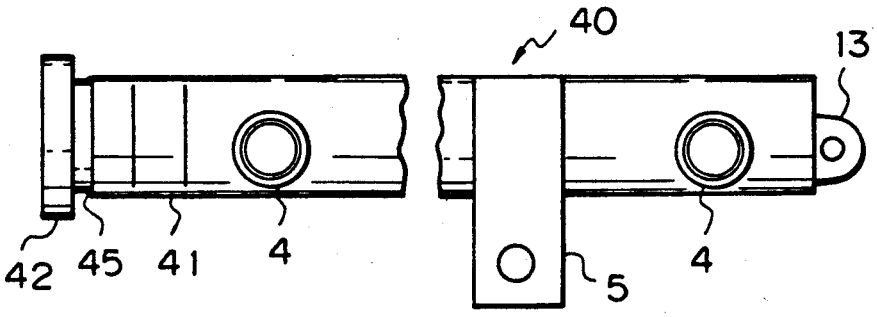
FIG. 6 is a bottom view of FIG. 5.
Figure 7:
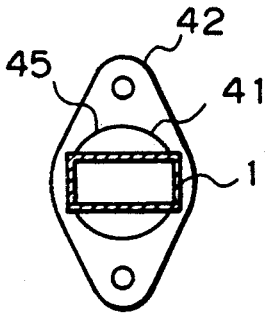
FIG. 7 is a sectional view taken along the line VII—VII in FIG. 5.
Figure 8:
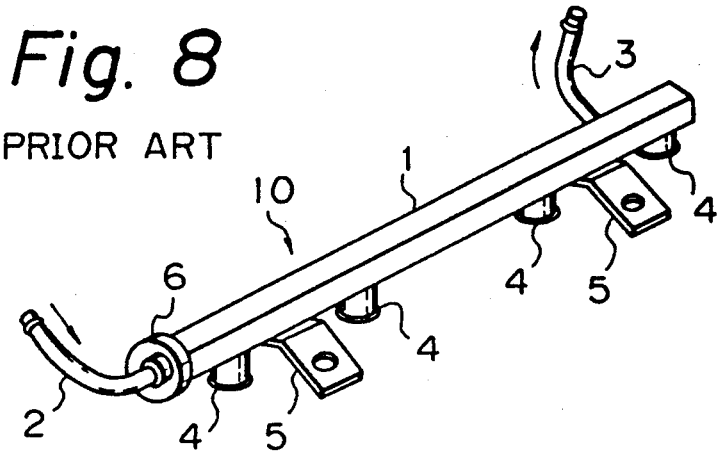
Fig. 8 PRIOR ART
FIG. 8 is a perspective view of a conventional fuel delivery rail assembly for a straight-type 4 cylinder engine.
Figure 9:
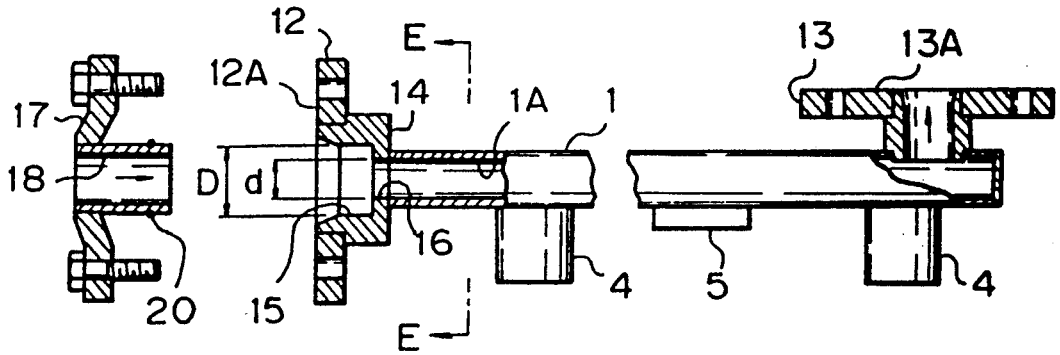
Fig. 9 PRIOR ART
FIG. 9 is a partly broken away vertical sectional view, similar to FIG. 5 of another conventional fuel delivery rail assembly.
Figure 10:
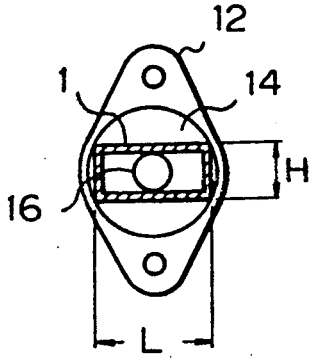
Fig. 10 PRIOR ART
FIG. 10 is a sectional view taken along the line E—E in FIG. 9.
Figure 11A:
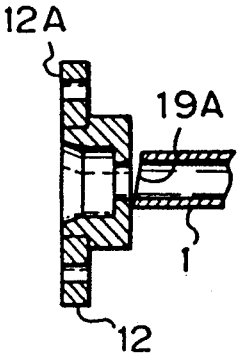
Fig. 11(A) PRIOR ART
FIG. 11A and 11B are partial sectional views illustrating two connecting portions between a conventional adaptor and a conduit.
Figure 11B:
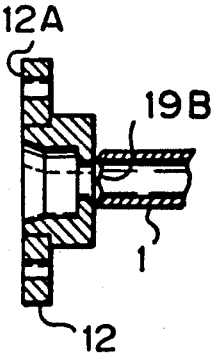
Fig. 11(B) PRIOR ART

Referring to FIGS. 5 to 7, there is shown a fuel delivery rail assembly 40 of the second type. Some portions are omitted for illustrative simplification. In FIG. 5, a front end 41 at the inlet side of the conduit 1, which has a rectangular hollow section with a fuel passage 1A therein, is enlarged from its inside and its sectional form is transformed into a circular hollow section by well known extending work. In preparing the conduit 1, a midpoint of the conduit 1 is clamped by a chuck and then a conical punch is inserted into the inside of the front end 41. Within the front end 41, a cylindrically machined surface 43 of the adaptor 42 is inserted and brazed together along the peripheral portion 45. During the brazing work, the alignment between the vertical plane of the flange surface 42A of the adaptor 42 and the axial directions of the sockets 4 can be carefully adjusted, so that a complete connection is established for eliminating fuel leakage after bolting up of the connection.

In FIG. 5, although the surface 43 is machined in stepped form so as to provide a stable fitting, this machining work can be reduced for economical purpose. Within the fuel inlet opening 47 disposed at the center of the adaptor 42, a fuel inlet pipe 18 mounted on the associated adaptor 17 is inserted and sealed therewith by an O-ring 20. As a modified construction, a single piece of the fuel inlet pipe 18 can be directly inserted into the fuel inlet opening 47 and brazed together.

FIG. 6 shows a bottom configuration of the fuel delivery rail assembly 40 in FIG. 5. It can be easily understood from this figure that the enlarged front end 41 of the conduit is conveniently welded to the adaptor 42 by the brazing connection 45.

FIG. 7 shows an edge configuration of the fuel delivery rail assembly in FIG. 5. It can be easily understood from this figure that the enlarged circular section 41 is an extension of the rectangular conduit 1 and that the enlarged front end 41 is conveniently welded to the adaptor 42 by the brazing connection 45.

It is noted that the present invention can be applied to a fuel delivery rail assembly utilized for an engine other than the aforesaid straight-type 4 cylinder engine.

Thus, as is apparent from the above description, the fuel delivery rail assembly of the invention can provide technical advantages as follows:

(1) Welding defects are reduced and a precisely aligned fuel delivery rail assembly is obtained.

(2) Since several kinds of working and inspection steps can be saved, the fuel delivery rail assembly becomes economical and easy to manufacture.

(3) Since fuel can flow into the conduit more smoothly than in the prior art, a pressure loss at the inlet side is considerably reduced, whereby speedy response and control of the engine is satisfactorily established.

I claim:

1. A fuel delivery rail assembly for an internal combustion engine, comprising:

an elongated conduit having a fuel passage defined therethrough and having a rectangular hollow cross section along substantially its entire length;

a plurality of sockets attached to an extending perpendicularly from said elongated conduit, one end of each of said plurality of sockets being in fluid communication with said fuel passage and the other end of each of said plurality of sockets being adapted to receive a tip of a fuel injector;

a fuel inlet pipe having a circular hollow cross section smaller than that of said elongated conduit, one end portion of said fuel inlet pipe being received in one end portion of said elongated conduit and secured thereby by brazing; and wherein said one end portion of said elongated conduit defines a transformation portion which decreases gradually and smoothly in cross sectional area from a location where it meets said rectangular hollow cross section to an extreme end of said elongated conduit where it defines a circular hollow cross section which has an inside diameter substantially equal to an outside diameter of said fuel inlet pipe.

2. A fuel delivery rail assembly as recited in claim 1, wherein said fuel inlet pipe has a substantially constant cross section throughout its length.

3. A fuel delivery rail assembly as recited in claim 1, wherein said one end portion of said fuel inlet pipe has a greater cross sectional area than a remainder of said fuel inlet pipe, said cross section increasing smoothly and gradually from a predetermined location to a location at which an outside diameter thereof is substantially equal to an inside diameter of said extreme end of said elongated conduit.

4. A fuel delivery rail assembly for an internal combustion engine, comprising:

an elongated conduit having a fuel passage defined therethrough and having a rectangular hollow cross section along substantially its entire length;

a plurality of sockets attached to and extending perpendicularly from said elongated conduit, one end of each of said plurality of sockets being in fluid communication with said fuel passage and the other end of each of said plurality of sockets being adapted to receive a tip of a fuel injector;

one end portion of said elongated conduit defines a transformation portion which increases gradually and smoothly in cross sectional area from a location where it meets said rectangular hollow cross section to an extreme end of said elongated conduit where it defines a circular hollow cross section;

an adaptor having a circular hollow cross section with an outside diameter substantially equal to an inside diameter of said circular hollow cross section at said extreme end of said elongated conduit, said adaptor being received in said one end portion of said elongated conduit and secured thereto by brazing; and a fuel inlet pipe having a circular hollow cross section with an outside diameter substantially equal to an inside diameter of said adaptor, said fuel inlet pipe being received in said adaptor.

5. A fuel delivery rail assembly as recited in claim 4, wherein said adaptor is substantially straight.

6. A fuel delivery rail assembly as recited in claim 4, wherein said fuel inlet pipe has a substantially constant cross section throughout its length.

7. A fuel delivery rail assembly as recited in claim 4, wherein said adaptor and said fuel inlet pipe are substantially longitudinally aligned with said elongated conduit.

* * * * *